US005802637A

United States Patent [19]

Bordo

[11] Patent Number: 5,802,637

[45] Date of Patent: Sep. 8, 1998

[54] DUST RUFFLE CONSTRUCTION

[76] Inventor: Nancy Bordo, 200 E. 27th St., Apt. 11D, New York, N.Y. 10016

[21] Appl. No.: 779,168

[22] Filed: Jan. 6, 1997

[51] Int. Cl.[6] ..... A47C 31/11; A47G 9/04

[52] U.S. Cl. ..... 5/493; 5/663; 5/907; 5/53.1; 5/490; 297/219.11

[58] Field of Search ..... 248/345.1; 297/219.1, 297/228.11, 228.12, 228.13; 5/482, 486, 490, 496, 493, 498, 502, 663, 907, 53.1

[56] References Cited

U.S. PATENT DOCUMENTS

| | | | |
|---|---|---|---|
| 674,609 | 5/1901 | Higley | 5/493 X |
| 3,999,233 | 12/1976 | Morris | 5/493 |
| 4,141,097 | 2/1979 | Levinsohn et al. . | |
| 4,587,683 | 5/1986 | Gardiner . | |
| 4,796,317 | 1/1989 | Kallman et al. . | |
| 4,807,316 | 2/1989 | Whipple . | |
| 5,063,626 | 11/1991 | Carlos . | |
| 5,086,531 | 2/1992 | Carlos . | |
| 5,271,112 | 12/1993 | Bible et al. . | |
| 5,335,383 | 8/1994 | Schwind . | |
| 5,404,601 | 4/1995 | O'Neill . | |

FOREIGN PATENT DOCUMENTS

| | | | |
|---|---|---|---|
| 563138 | 6/1975 | Switzerland | 5/663 |
| 20213 | 9/1913 | United Kingdom | 5/493 |
| 420333 | 11/1934 | United Kingdom | 5/493 |

*Primary Examiner*—Michael F. Trettel
*Attorney, Agent, or Firm*—Gottlieb, Rackman & Reisman, P.C.

[57] ABSTRACT

An improved dust ruffle or fabric skirt design is provided, which is readily placeable about and removable from a bed or other structures in the home. The skirt comprises an elongated fabric sleeve having a first end and a second end and includes an outer fabric wall and an inner fabric wall. The fabric walls define an elongated passage in which an elongated elastic tape member is received intermediate the two walls. The tape member is elasticized in order to provide, when stretched and in place around a box spring or other structure, an inwardly directed force against the inner fabric wall in order that the skirt or ruffle can be fixed in place on a bedding assembly, a furniture piece, or some other home fixture. The tape member may be removed from the passageway of the fabric sleeve before washing or laundering the skirt or dust ruffle.

27 Claims, 12 Drawing Sheets

FIG.6
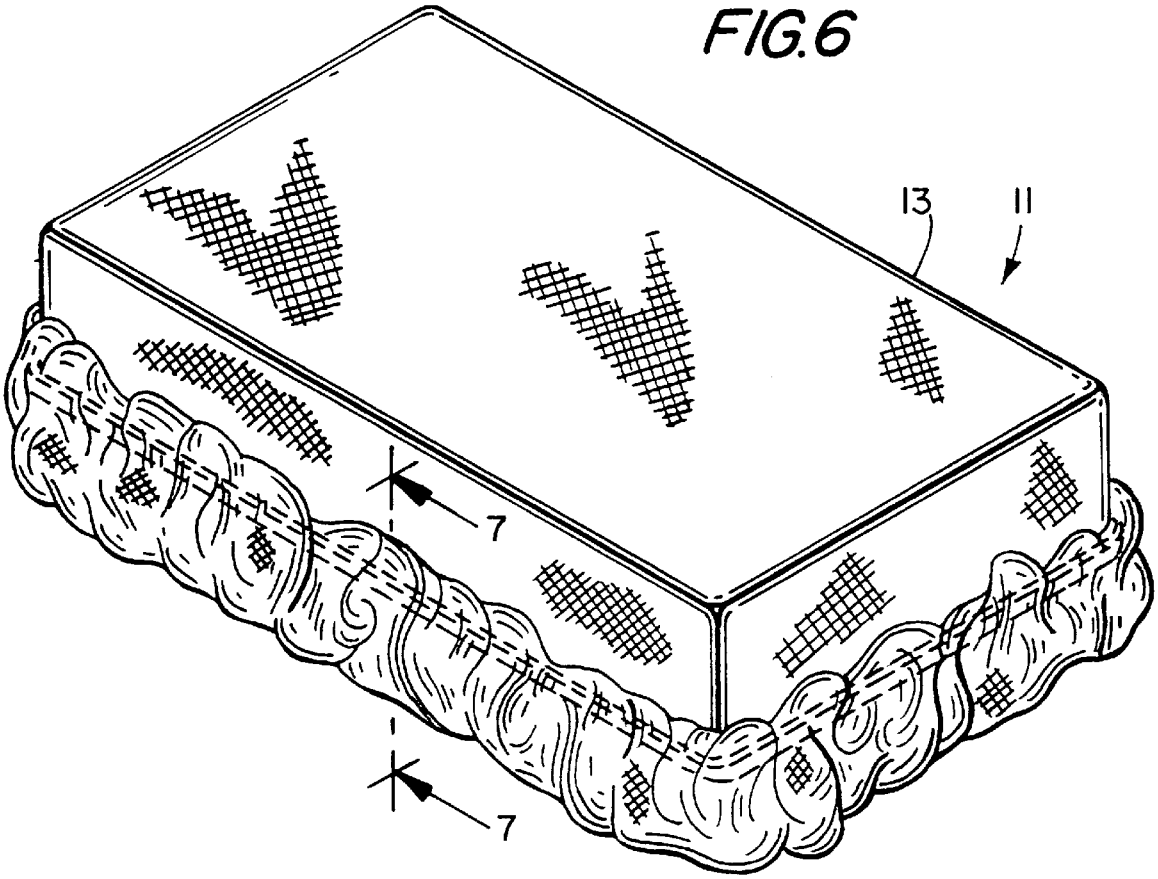
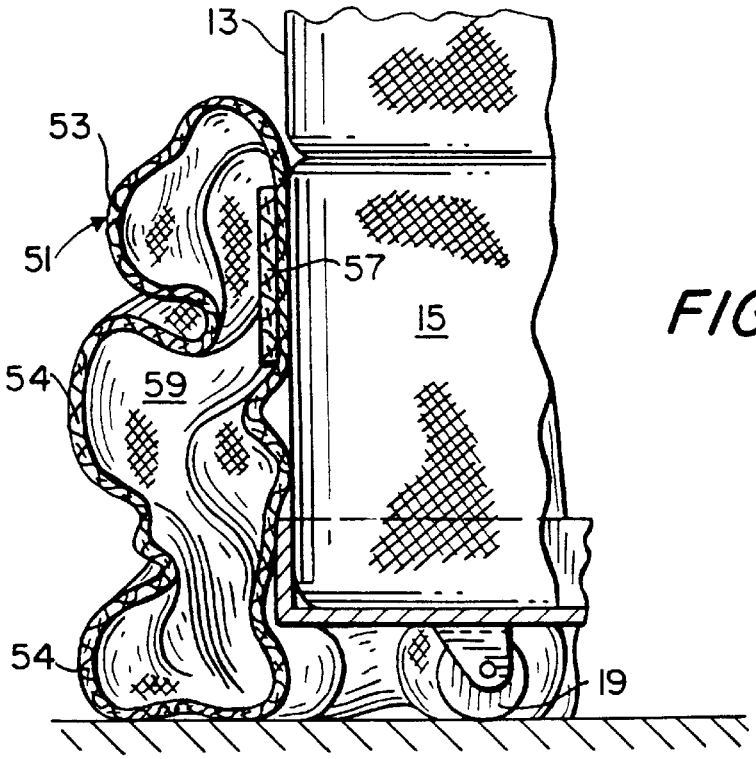
FIG.7

72
78
77
70
68
71
76
79

23
63
9
65
11
13
67
9
10
71
61
10

FIG. 14
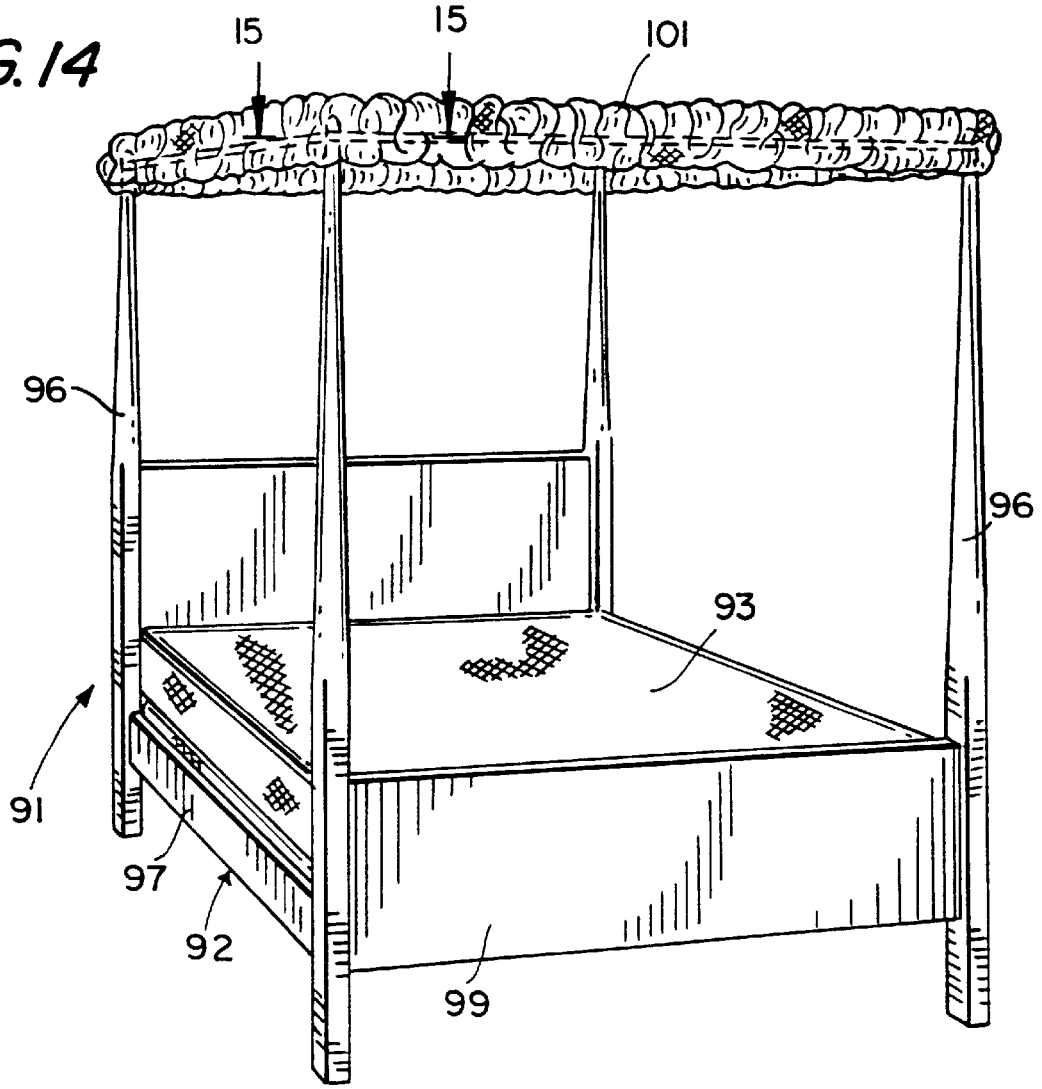
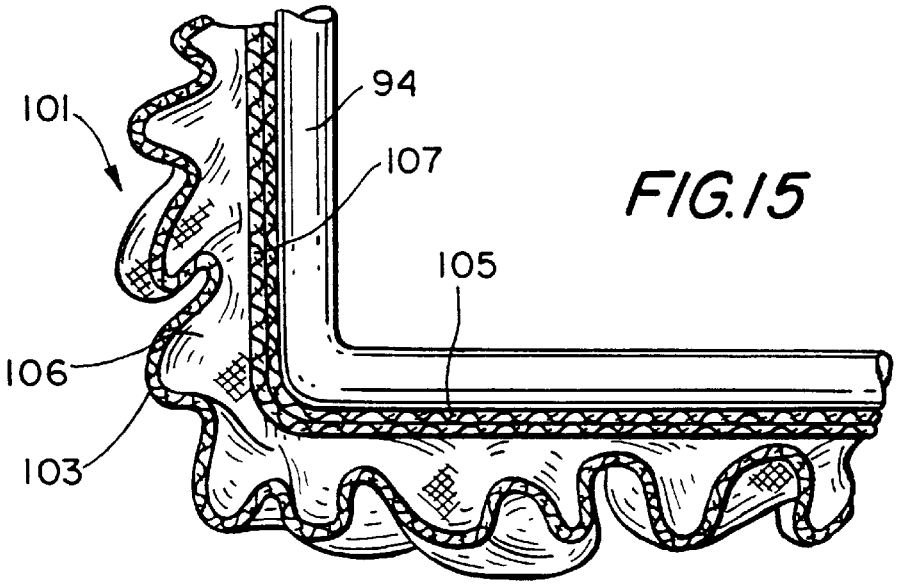
FIG. 15

FIG. 16
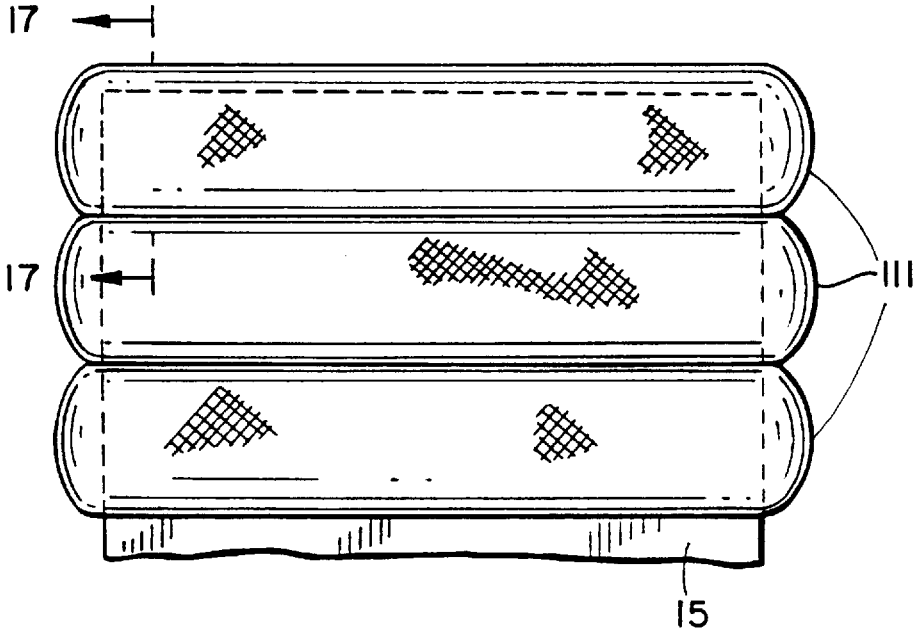
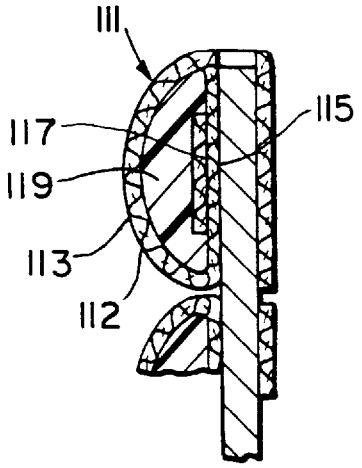
FIG. 17

DUST RUFFLE CONSTRUCTION

BACKGROUND OF THE INVENTION

This invention relates to a bedding and furniture accessory, and more particularly to a bedding or furniture dust ruffle construction incorporating an innovative design for applying and removing the dust ruffle to and from beds, chairs and other pieces of furniture.

In order to improve the appearance of the usual box spring and mattress combination, a dust ruffle is added to that ensemble and yields a decorative finished look. The dust ruffle comprises a skirt of material for covering the outer edge of the box spring, and typically extends almost to the floor. A conventional dust ruffle has a center rectangular sheet which conforms in size to the top surface of the box spring. The skirt portion of the dust ruffle is attached along the outer edge of the rectangular sheet.

In order to place this type of conventional dust ruffle on a bed, it is of course necessary to remove the mattress, and then spread the dust ruffle on the box spring and place the mattress back in position on the box spring. This procedure is not only used in placing the dust ruffle over the box spring, but it also must be used for removing it, as required for the purposes of cleaning and/or washing the dust ruffle.

Although this type of dust ruffle design provides a satisfactory aesthetic appearance, the process of attaching and removing such a dust ruffle is both cumbersome and difficult, often requiring two or more people to lift mattress from the box spring. This effort discourages such removal and replacement, which is a significant disadvantage.

A number of designs have been proposed in the past in which the center lining sheet is absent, in order to facilitate the placement of a dust ruffle. However, such designs often require the use of pins or some other attachment mechanism or system for fixing a dust ruffle around the box spring. This makes it difficult to wash and/or clean the dust ruffle, as the attachment mechanism can be worn or damaged during the usual washing or cleaning process.

Accordingly, it would be desirable to provide an improved bedding or furniture dust ruffle construction which overcomes the above disadvantages and which can also be easily manufactured inexpensively. In addition, it would be desirable to provide an improved dust ruffle construction which enables the dust ruffle to assume various decorative "looks."

SUMMARY OF THE INVENTION

In accordance with the present invention, an improved dust ruffle construction is provided, which includes an elongated fabric sleeve having an outer fabric wall and an inner fabric wall, and a pair of ends. The fabric walls define an elongated hollow fabric passage within which is situated an elongated elastic tape member.

The elastic tape member has first and second ends which extend beyond the ends of the sleeve. In accordance with the invention, there is provided an attachment member for selectively connecting the ends of the elastic tape so that the skirt of the dust ruffle is girdled by the elastic tape and thus fixed in position on the bed or other furniture item as desired by the user.

In a preferred embodiment, the attachment comprises one or more hook members fixed to one end of the elastic tape member and one or more corresponding eyelets formed at the other end of the elastic tape member for selectively engaging with the hook members.

Significantly, in order to wash or otherwise clean the skirt component of the dust ruffle construction of the invention, after the skirt is removed from the bedding or furniture, the elastic tape member may be removed from its position within the walls of the sleeve and temporarily stored while the fabric sleeve is washed or laundered. Once cleaning has been completed, the elastic tape member is then reinserted within the sleeve between its walls, and the dust ruffle is then ready to once again be placed on the box spring or other furniture as desired. Since, as mentioned, there is no top lining sheet in the present dust ruffle construction, the dust ruffle construction can be placed quickly and easily on the bed without removing the mattress.

As can be appreciated, the dust ruffle design of the invention can have any type of aesthetic appearance or design, including ruffles and the like, all within the inventive concept.

Additionally, the dust ruffle construction of the invention may include a foam insert disposed within the fabric sleeve and adjacent the elastic tape member running therethrough in order to produce a defined shape or body to the dust ruffle when it is fitted on a bed or other piece of furniture.

Accordingly, it is an object of the invention to provide an improved dust ruffle construction for bedding, furniture and the like.

Still another object of the invention is to provide an improved dust ruffle design which can be quickly and easily installed or removed from a bed, without any need to displace the mattress.

A further object of the invention is to provide an improved dust ruffle design which can be easily washed or laundered without damage thereto.

Still other objects and advantages of the invention will in part be obvious and will in part be apparent from the following description.

BRIEF DESCRIPTION OF THE DRAWINGS

For a fuller understanding of the invention, reference is made to the following description, taken in conjunction with the accompanying drawings, in which:

FIG. 6 is a perspective view illustrating a third embodiment of the dust ruffle construction of the invention in which the skirt is loosely fitted along the box spring to give a "full" or "fluffy" look;

FIG. 7 is an enlarged cross-sectional view taken along line 7—7 of FIG. 6;

FIG. 14 is a perspective view of a canopy bedding assembly to which a sixth embodiment of the dust ruffle construction is applied, in accordance with the invention;

FIG. 15 is an enlarged, partial cross-sectional view taken along line 15—15 of FIG. 14;

FIG. 16 is a front elevational view of a seventh embodiment of the dust ruffle construction of the invention, placed about a headboard;

FIG. 17 is an enlarged cross-sectional view taken along line 17—17 of FIG. 16.

DETAILED DESCRIPTION OF THE PREFERRED EMBODIMENT

Figure 1:
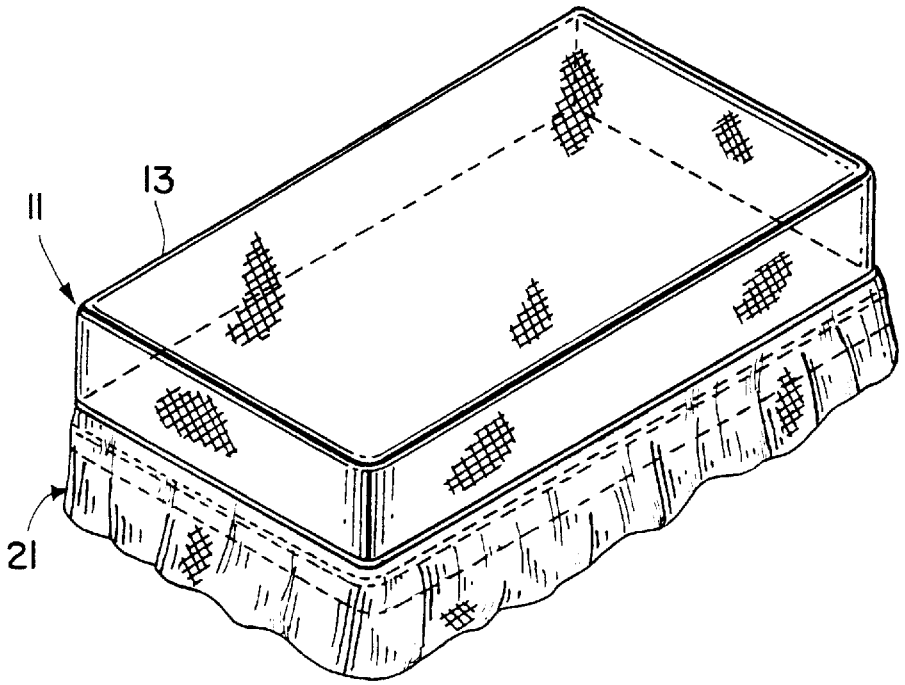
FIG. 1 is a perspective view of a bed assembly including a mattress and box spring, in which one embodiment of the dust ruffle construction of the invention has been placed around the box spring.

Referring first to FIGS. 1–5, a first embodiment of the dust ruffle construction of the invention is generally indicated at 21. Dust ruffle 21 is used in combination with a bed assembly generally indicated at 11. Bed assembly 11 includes a conventional rectangularly configured mattress in which sits on and is supported by a similarly shaped conventional box spring 15, as is well known. Box spring 15 sits on and is held by a conventional metal frame 17 having a set of wheels 19 for both supporting bed assembly 11 and for enabling bed assembly 11 to be positioned or moved along a floor.

Figure 2:
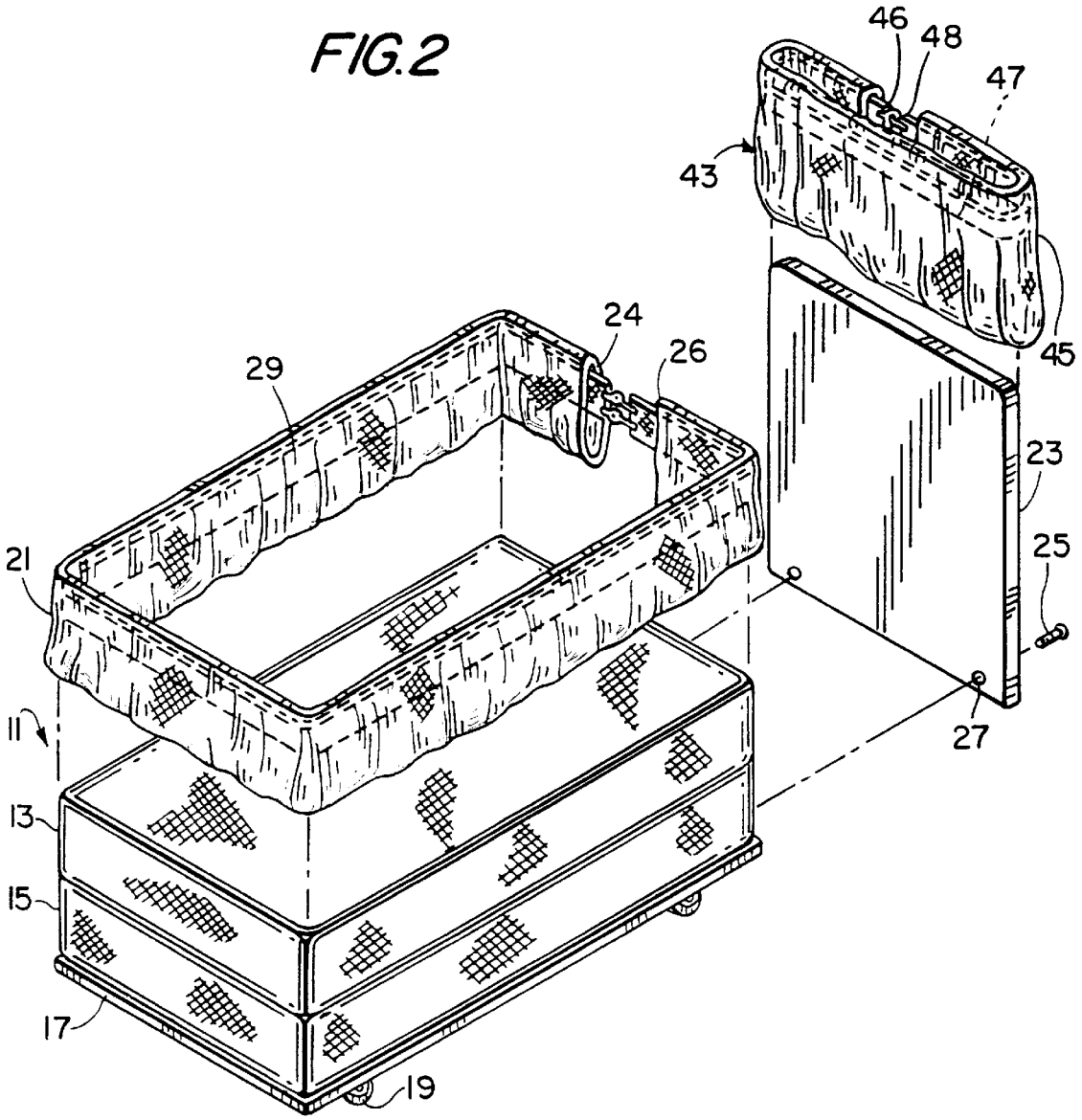
FIG. 2 is an exploded perspective view of the assembly illustrated in FIG. 1, being shown in combination with a headboard to which a second embodiment of the dust ruffle construction made in accordance with the invention is applied.
Figure 3:
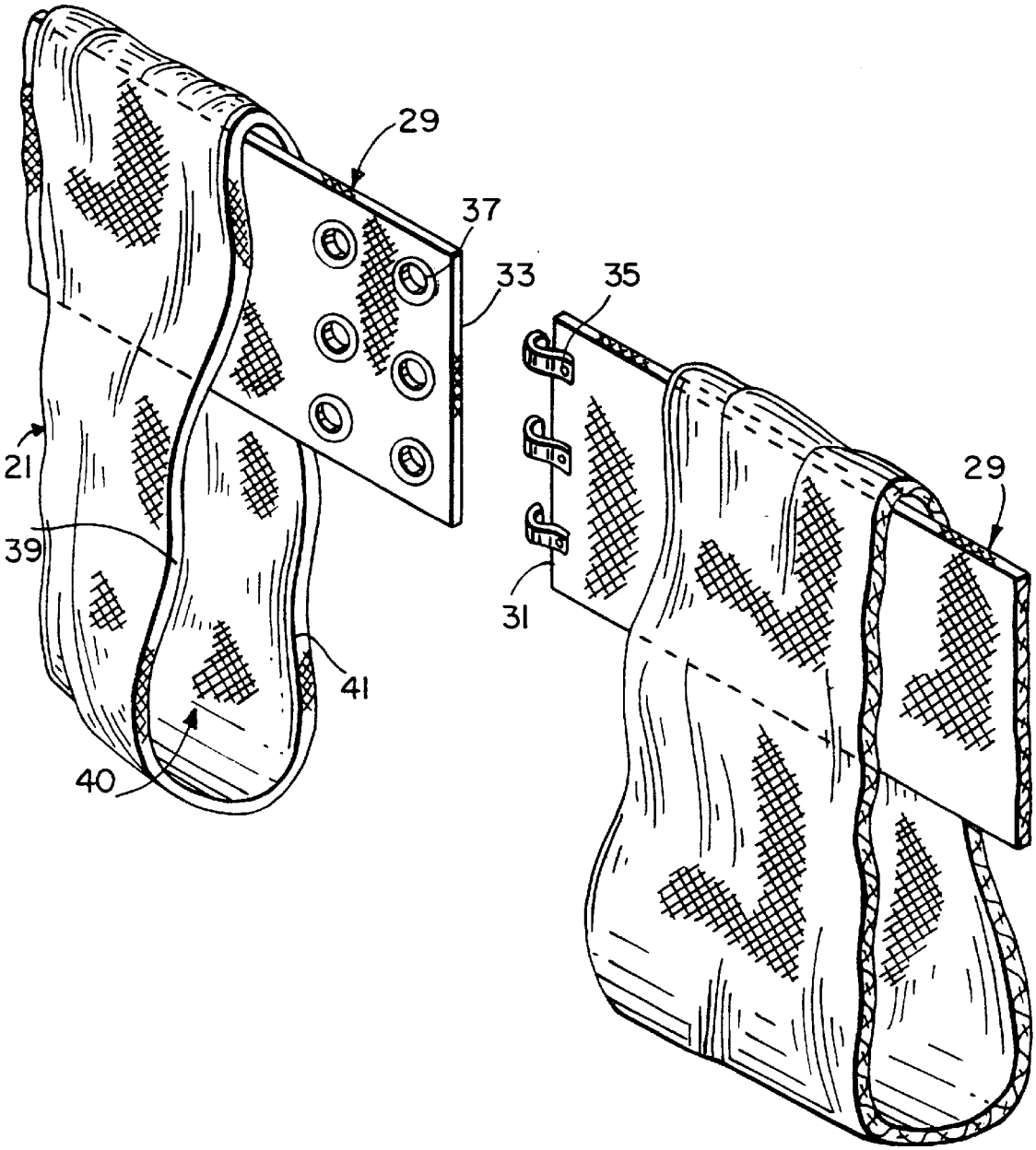
FIG. 3 is a perspective view illustrating the hook and eyelet elements located on the ends of the elastic tape member that are used in fixing the fabric skirt of the dust ruffle construction of FIG. 1 in place about the box spring.
Figure 5:
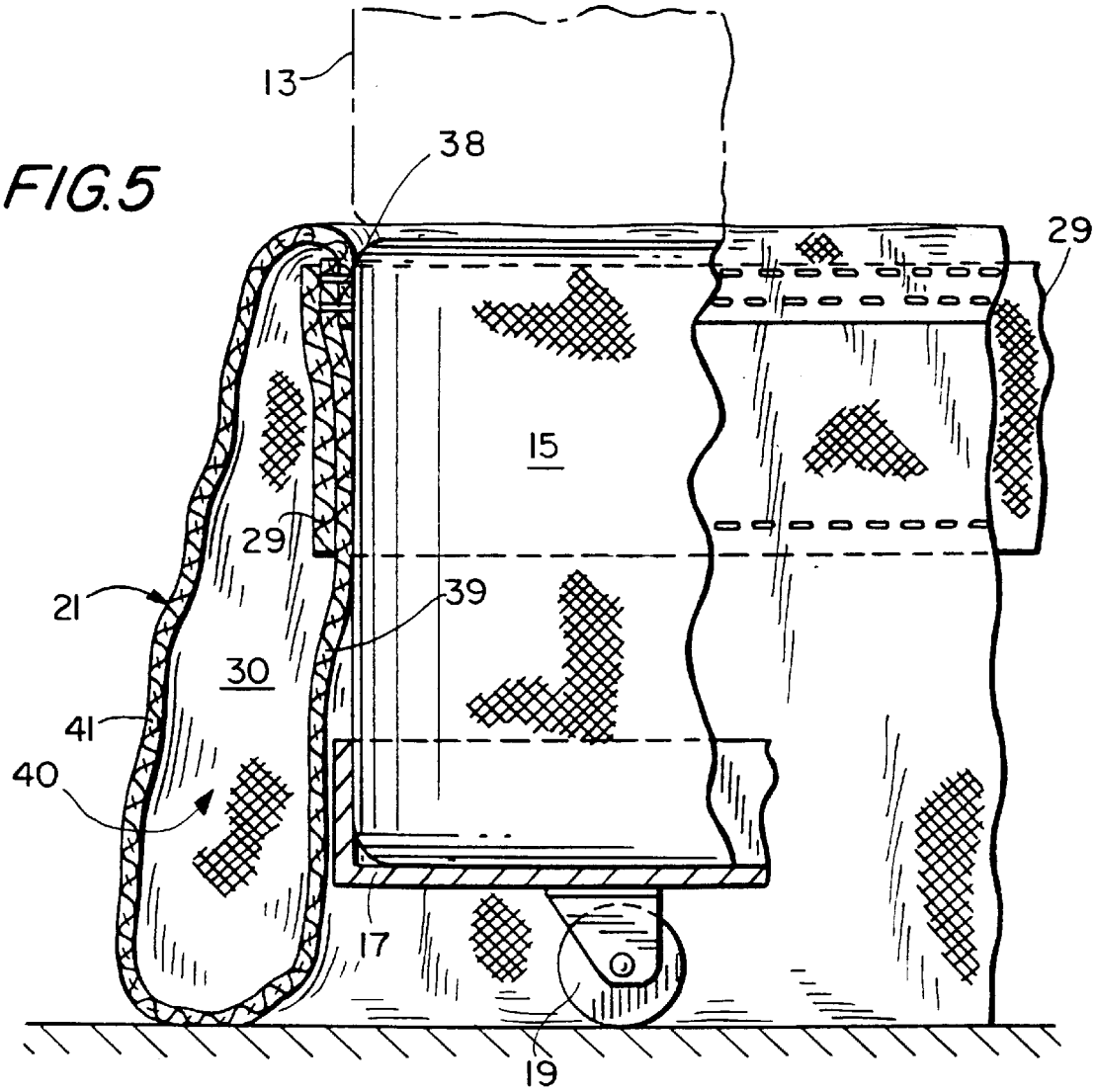
FIG. 5 is an enlarged cross-sectional view taken along line 5—5 of FIG. 4.

As best shown in FIGS. 2, 3 and 5, dust ruffle 21 includes an elongated hollow fabric sleeve 22 having a pair of ends, namely a first end 24 and a second end 26. Sleeve 22 is constructed with an outer fabric wall 41 and an inner fabric wall 39 which together define a longitudinally extending elongated hollow passage 40 within sleeve 22. The walls 39 and 41 are joined along a stitch line 38 (see FIG. 5). Passage 40 of sleeve 22 is sized and designed for receiving an elastic tape member 29, as shown in phantom in FIGS. 1 and 2, and in detail in FIGS. 3 and 5.

Elastic tape member 29 is made from conventional elastic material, takes up only a portion of the hollow interior of the sleeve, and extends beyond the ends 24 and 26 of sleeve 22. Elastic tape member 29, as best shown in FIGS. 2 and 3, has ends which can be joined. By way of example, end 31 has a plurality of hooks 35 fixed thereto, and a second end 33 has two rows of eyelets 37. Each row of eyelets formed in end 33 of tape member 29 corresponds in number to the number of hooks 35 fixed to end 31 of tape member 29. Each of eyelets 37 is sized for selective engagement with hooks 35, as described below.

Figure 4:
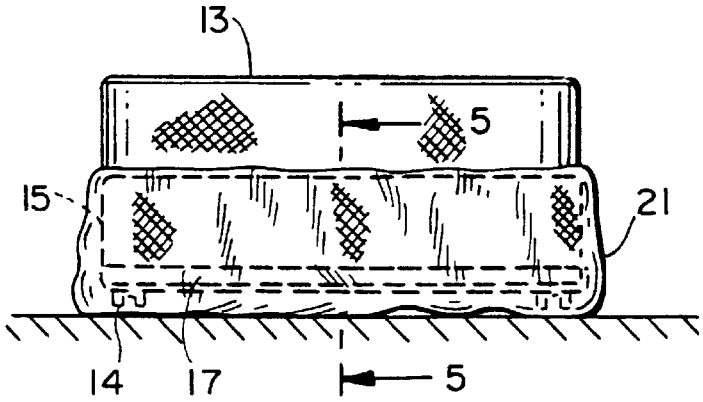
FIG. 4 is a front elevational view illustrating the dust ruffle construction shown in FIG. 1.

In order to place dust ruffle 21 about the outside of box spring 17 (see FIG. 1), sleeve 22 of dust ruffle 21 is wrapped around the outside wall of box spring 15 at a height which the user desires. Since the rearmost wall of box spring 15 will normally not be visible, ends 24 and 26 of sleeve 22 are situated at that location (see FIG. 2). Then, the tape is "stretched" by the user so that hook elements 35 of end 31 can be fastened to one row of eyelets 37 in order to fix dust ruffle construction 21 about bed assembly 11, as shown in FIGS. 1 and 4. As can be appreciated, elastic tape member 29 running through passage 40 of sleeve 22 when stretched provides an inwardly directed force, urging inner wall 39 frictionally against the outer surface of box spring 15 in order to ensure that ruffle construction 21 is maintained in position about bed assembly 11. (Note that the mattress need not be removed in this placement.)

In order to remove dust ruffle construction 21 from bed assembly 11, hook elements 35 are disconnected from eyelets 37 in order to separate ends 31 and 33 respectively of tape member 29. This enables the dust ruffle construction 21 to be easily removed from the box spring 15. If cleaning or laundering of dust ruffle 21 is desired, elastic tape member 29 is completely removed within passage 40 and then the sleeve 22 can be washed. In other words, washing or laundering of dust ruffle 21 may be accomplished without running the risk of damaging any portion of elastic tape member 29, or otherwise reducing its elasticity.

In particular, tape member 29 is removed by the user from within sleeve 22 of dust ruffle 21 during washing, and is reinserted within sleeve 22 once the cleaning process of the sleeve 22 has been completed. After washing dust ruffle 21, and following reinsertion of tape member 29 within sleeve 22, dust ruffle 21 may be placed about the outside of box spring 21 such that sleeve 22 is wrapped therearound, as described above.

Referring now to FIG. 2, bed assembly 11 may also include a conventional headboard 23 connected to the back end of the bed frame via a pair of corresponding screws 25, as is well known in the art.

As shown in FIG. 2, headboard 23 receives a cover 43 made in accordance with the inventive design. Cover 43 corresponds in design and configuration to dust ruffle construction 21 and comprises a hollow fabric sleeve 45 through which an elastic tape member 47 runs. Tape member 47 includes a hook attachment assembly at its ends 46 and 48 which are designed in a manner similar to the hook assembly of tape member 29 (described above). As can be appreciated, cover 43 is placed and fixed around headboard 23, and can be removed therefrom for cleaning purposes, in a manner similar to attaching dust ruffle 21 to box spring 15 of bed assembly 11.

Referring now to FIGS. 6 and 7, an alternative embodiment of a dust ruffle construction made in accordance with the invention is described and generally indicated at 51. Dust ruffle construction 51, like dust ruffle construction 21 illustrated in FIGS. 1–5, is designed for placement around box spring 15 of bed assembly 11, and comprises a hollow fabric sleeve 53 formed with a plurality of folds 54 which together create a desirable "ruffled" appearance. Fabric sleeve 53 defines an elongated passage 59 in which an elastic tape member 57 is disposed at the upper portion of the sleeve. Elastic tape member 57 is similar in design to the design of elastic tape member 29 described in the embodiment of FIGS. 1–5, and is used for fixing ruffle 51 about box spring 15. As with tape member 29 of FIGS. 1–5, tape member 29 may be removed from sleeve 53 if cleaning or laundering of dust ruffle 51 is desired.

Figure 8A:
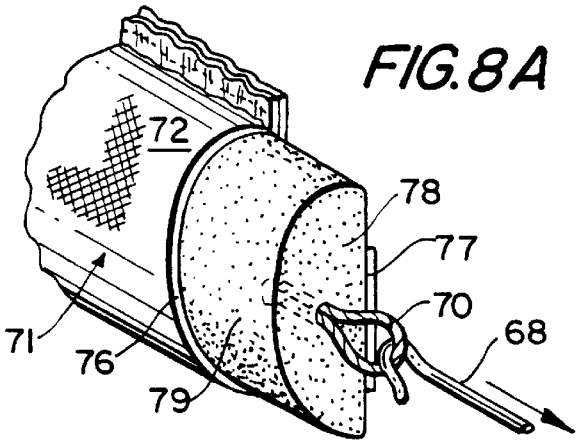
FIG. 8A is a partial cutaway perspective view illustrating the removal of a foam insert that is part of the dust ruffle construction depicted in FIG. 8.
Figure 8:
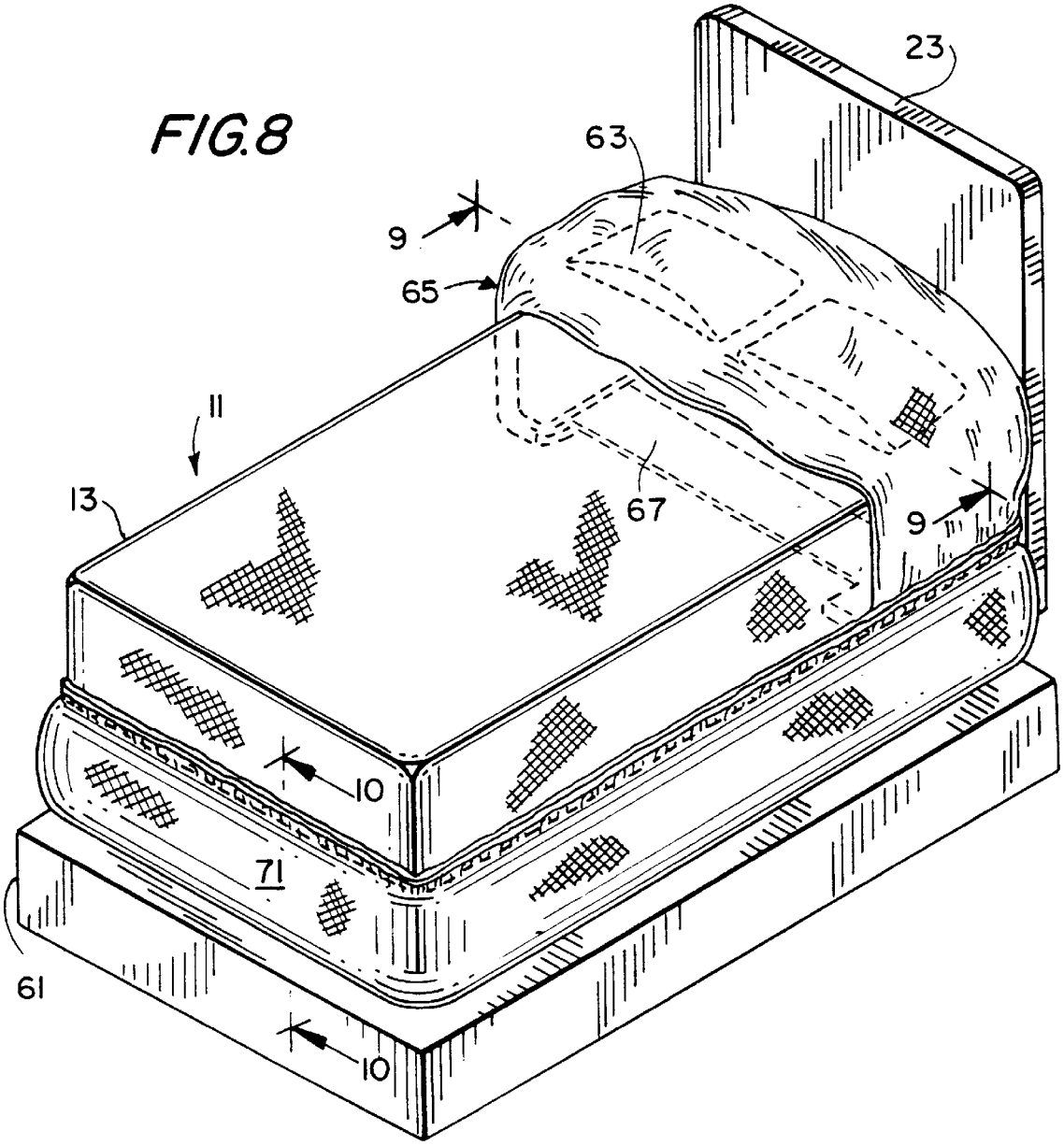
FIG. 8 is a perspective view illustrating a fourth embodiment of the dust ruffle construction of the invention in which the skirt is placed along the box spring and above a platform, and further illustrates a dust ruffle construction to cover a bed pillow, made also in accordance with the invention.
Figure 9:
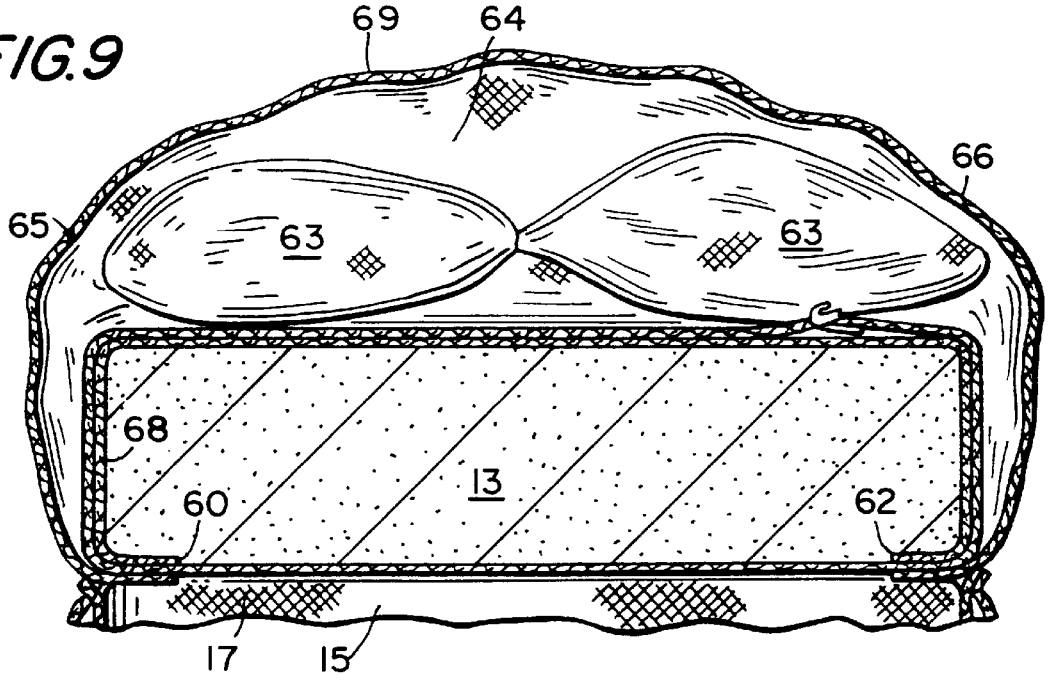
FIG. 9 is an enlarged cross-sectional view taken along line 9—9 of FIG. 8.
Figure 10:
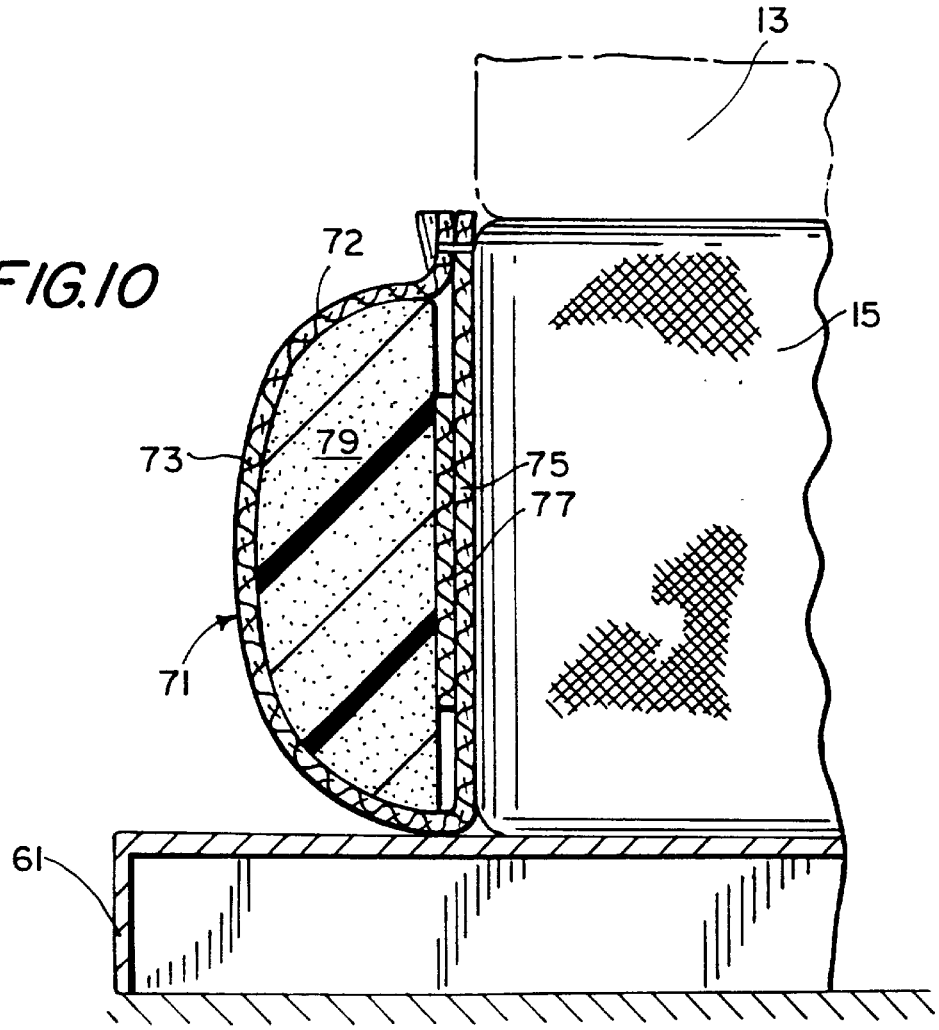
FIG. 10 is an enlarged cross-sectional view taken along line 10—10 of FIG. 8.
Figure 11:
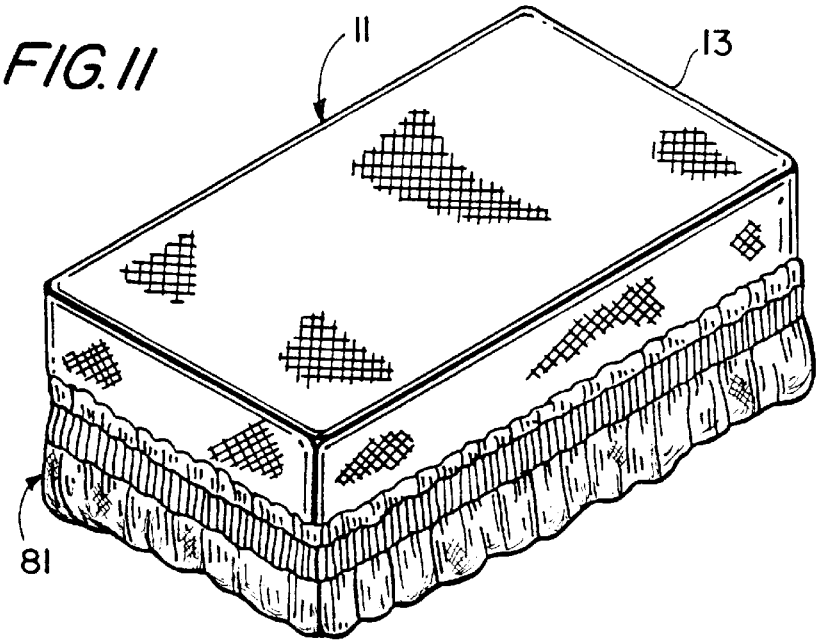
FIG. 11 is a perspective view illustrating a fifth embodiment of the dust ruffle construction of the invention placed about a box spring.

Turning now to FIGS. 8–10, a further embodiment of a dust ruffle construction made in accordance with the invention is described and generally indicated at 71. Dust ruffle 71 is disposed along the exterior surface of box spring 15 (see FIG. 8) as is known. In this embodiment, bed assembly 11 comprises mattress 13 and box spring 15, both of which are supported on rectangular floor pedestal or platform 61. Assembly 11 further includes headboard 23 which is fixed to pedestal 61 in a conventional fashion (not shown).

Dust ruffle 71 comprises a hollow fabric sleeve 72 with an outer fabric wall 73 and an inner fabric wall 75, as best shown in FIG. 10. Sleeve 72 has a hollow passage running through it in which one or more foam inserts or forms 79 is tightly disposed along substantially the entire length of sleeve 72. Foam insert or form 79 produces a substantially convex shape to outer fabric wall 73 of sleeve 72 and is sized to fit snugly in it. The use of form 79 (or any other shaped form) gives a "padded" or "fitted" look to the dust ruffle construction.

Referring to FIG. 10, dust ruffle 71 further includes an elastic tape member 77 running through sleeve 72 and disposed between form 79 and inner fabric wall 75. Elastic tape member 77 is designed similar to members 29 and 57 of the embodiments described hereinabove, and facilitates fixing dust ruffle 71 in position along the outside of box spring 15.

As best depicted in FIG. 8A, foam insert 79 of dust ruffle 71 has an exposed end 78 extending past sleeve 72 of dust ruffle 71. When dust ruffle 71 is fitted around box spring 15 (see FIG. 8), exposed end 78 is hidden behind bed assembly 11 and between box spring 15 and headboard 23. End 78 of insert 79 includes a loop member 70 fixed thereto and sized for grasping by a hook member 68. In order to selectively remove insert 79 from sleeve 72 of dust ruffle 71 (for washing ruffle 71), hook member 68 is coupled to loop member 70 as shown; hook member 68 is then pulled in the direction shown by the arrow in order to remove insert 79 from sleeve 72.

Continuing now with FIGS. 8–9, bed assembly 11 is utilized in connection with a pair of pillows 63 of conventional design, which are located side by side on mattress 13 and adjacent headboard 23. As shown, pillows 63 are housed in a fabric hollow casing 65 made in accordance with the inventive cover design and running laterally of the bed assembly. Casing 65 can either have the "sleek" design depicted in the drawings, or a frilly or ruffled appearance in order to create an aesthetically pleasing look. Casing 65, as best shown in FIG. 9, comprises a hollow sleeve 66 having an outer fabric wall 69 and an inner fabric wall 68 joined at a stitching line. Sleeve 66 has ends 60 and 62 and further defines a passage 64 in which pillows 63 are retained. Fabric casing 65 further includes an elastic tape member 67 running through passage 64.

Tape member 67, when stretched, urges fabric wall 68 of sleeve 66 inwardly so that inner fabric wall 68 wraps tightly around mattress 13. Sleeve 66 of casing 65 is designed and sized to accommodate pillows 63 within passage 64 and between tape member 67 and outer wall 69, as shown in FIG. 9. Significantly, ends 60 and 62 of sleeve 66 terminate just underneath the bottom side edges of mattress 13 such that casing 65 is fully visible from both the top and sides of bedding assembly 11, and is thus aesthetically pleasing.

Importantly, elastic tape member 67 is continuous by being joinable at its ends, as at 67*a*, by an appropriate fastener as shown previously, so that the tape may be readily attached or detached, permitting removal of the casing from the mattress. It can be wrapped entirely around mattress 13, ensuring that casing 65 will remain appropriately positioned on the bedding. Moreover, casing 65 may be designed in appearance in order to complement the design of ruffle 71.

Referring now to FIGS. 11–13A, still another embodiment of a dust ruffle construction made in accordance with the invention is described and generally indicated at 81. As with the previous embodiments, dust ruffle construction 81 is fitted by the user along the outside of box spring 15 of bedding assembly 11.

Figure 13A:
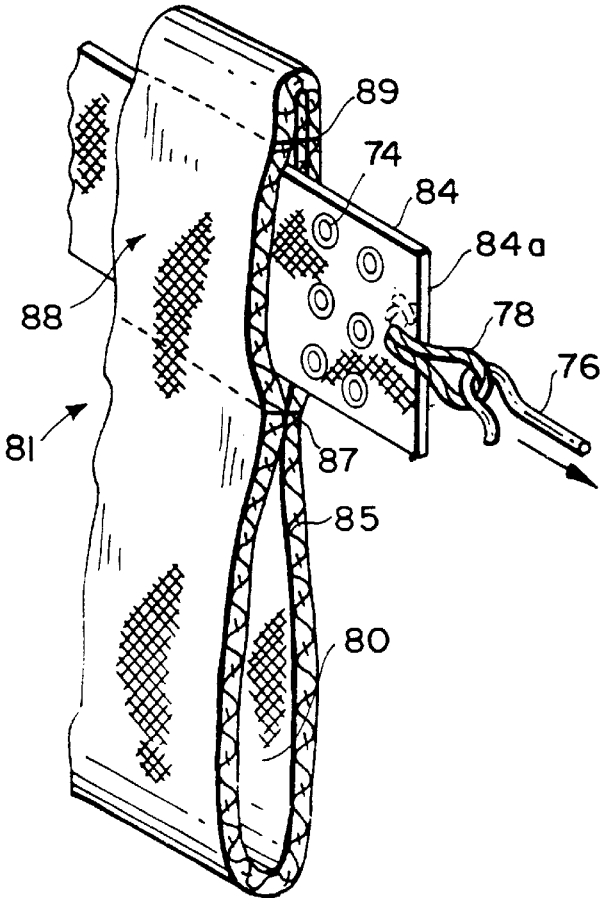
FIG. 13A shows insertion of the elastic tape for the dust ruffle construction shown in FIG. 13.
Figure 13:
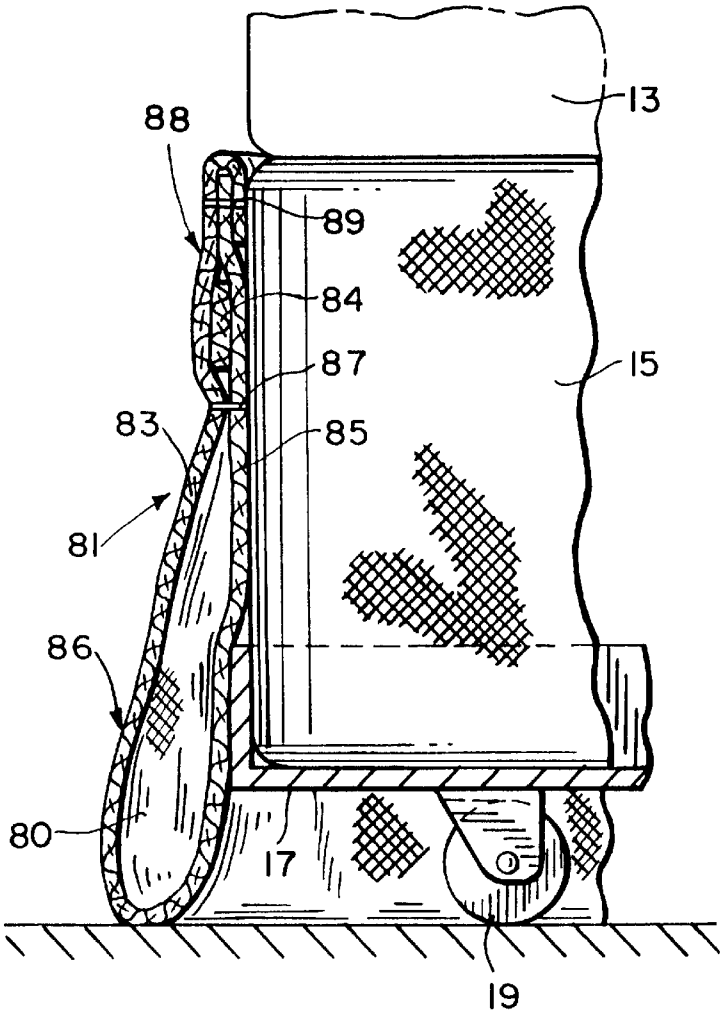
FIG. 13 is a cross-sectional view taken along line 13—13 of FIG. 12.
Figure 12:
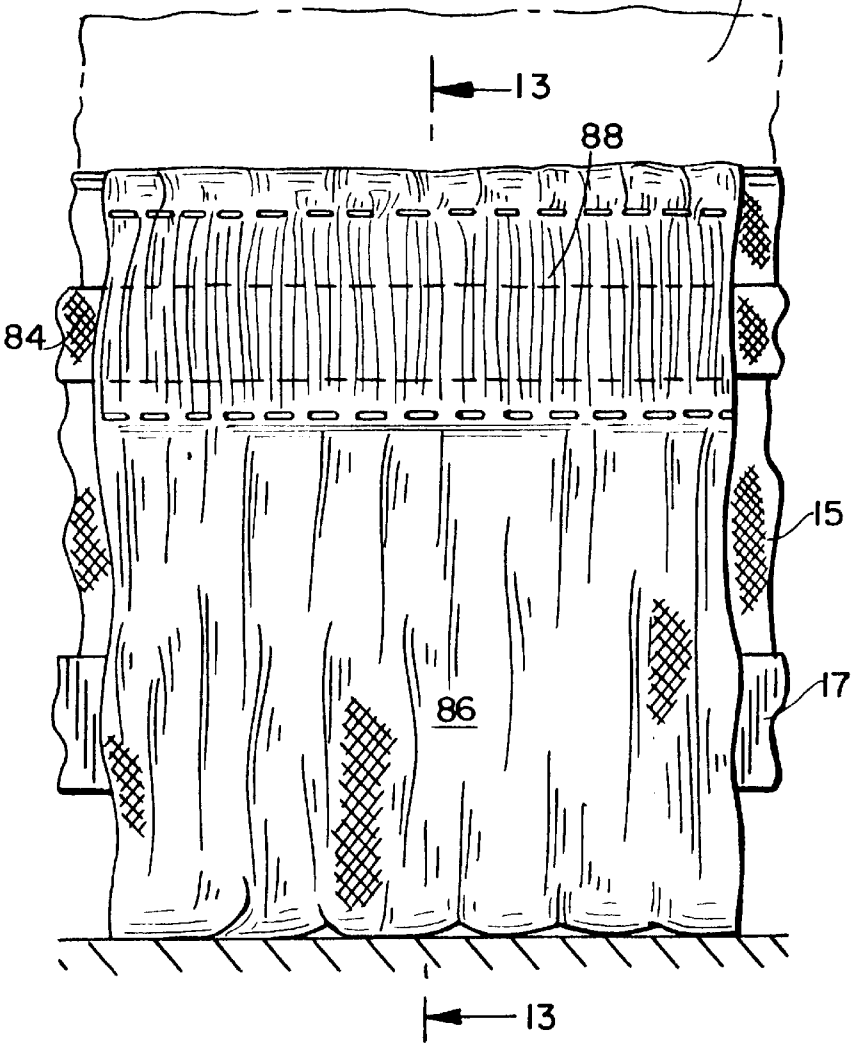
FIG. 12 is a front elevational view illustrating the dust ruffle construction depicted in FIG. 11.

With specific reference to FIGS. 12 and 13, dust ruffle 81 has a sleeve-like configuration and is formed with an outer fabric wall 83 and an inner fabric wall 85. Walls 83 and 85 are sewn together in a common longitudinal location along the entire length of dust ruffle 81 in order to form continuously running seams 87 and 89 which define an upper longitudinally extending passageway 82 in which an elastic tape member 84 is carried. Lower portion 86 of ruffle 81 hangs substantially all the way to the floor (see FIG. 13) and has a passage 80 running longitudinally therewithin.

Tape member 84, as with the tape members of the earlier embodiments, is used for fixing dust ruffle construction 81 in place along the outside of box spring 15 by providing an inwardly directed force on inner fabric wall 85 when stretched in place. The tape member 84 in this embodiment substantially fills the passageway 82 in which it sits; however, this passageway is substantially less in height than the entire dust ruffle construction. As before, tape member 84 includes a hook attachment mechanism (not shown) and a plurality of eyelets 74 for selectively attaching the ends thereof. Importantly, tape member 84 may be removed from upper portion 88 of dust ruffle 81 for washing or laundering purposes.

With reference now to FIG. 13A, end 84A of tape member 84 includes a loop member 78 fixed thereto and adapted for selectively coupling with a hook element 76. Like the embodiment described in FIG. 8A, hook element 76 is selectively pulled in the direction of the arrow in order to receive tape member 84 from passageway 82 of dust ruffle 81. This feature is especially important since tape member 84 fits tightly within and otherwise substantially fills passageway 82, rendering removal of tape member 84 difficult without having this hook/loop mechanism.

Referring now to FIGS. 14 and 15, a fabric canopy skirt made in accordance with the inventive design, and generally indicated at 101, is now described. Canopy or skirt 101 is used in conjunction with a "four-poster" bed assembly generally indicated at 91. Bed assembly 91 comprises a mattress 93 and similarly sized box spring 95, together received in a frame 92. Frame 92 comprises a pair of side walls 97, a headboard 98 and a footboard 99, as is well known in this type of bed assembly. Frame 92 further includes four vertically extending posts 96 located at the corners thereof on which a rectangular, tubular canopy frame 94 is mounted. Frame 94 is sized to receive canopy skirt 101, as best shown in FIG. 15.

Canopy skirt 101 comprises a hollow fabric sleeve 102 in the form of a plurality of ruffles or bouffants, as shown. Sleeve 102 includes an outer fabric wall 103 and an inner fabric wall 105 which together define a passage 106 running through skirt sleeve 102. An elastic tape member 107 runs through passage 106 and facilitates attachment of canopy skirt 101 to frame 94 by applying an inwardly directed force along the surface of frame 94. As with all of the previous embodiments, elastic tape member 107 may be selectively removed from passage 106 in order to clean or launder canopy skirt 101 as desired.

Reference is now made to FIGS. 16 and 17, which describe yet a further embodiment of the inventive skirt design. In this embodiment, three similarly configured dust ruffles or skirts 111 are placed along the outside of a headboard 15, as best depicted in FIG. 16, and are so arranged for decorative purposes. Each of skirts 111 has substantially the same configuration and design and each includes a fabric sleeve 112, with an outer fabric wall 113 and an inner fabric wall 115, together defining a passage running through sleeve 112. This passage is designed for receiving a specially shaped foam insert 119. As with the embodiment of FIGS. 8–10, foam insert 119 has a substantially semicircular configuration in cross-section, such that outer wall 113 of fabric sleeve 112 has a curved or convex configuration when viewed.

Each of skirts 111 further includes an elastic tape member 117 disposed in the passage of sleeve 112 between foam insert 119 and inner fabric wall 115. As before, elastic tape member 117 functions to urge inner wall 115 of sleeve 112 towards box spring 15 in order to secure skirt 111 in place.

Figure 18:
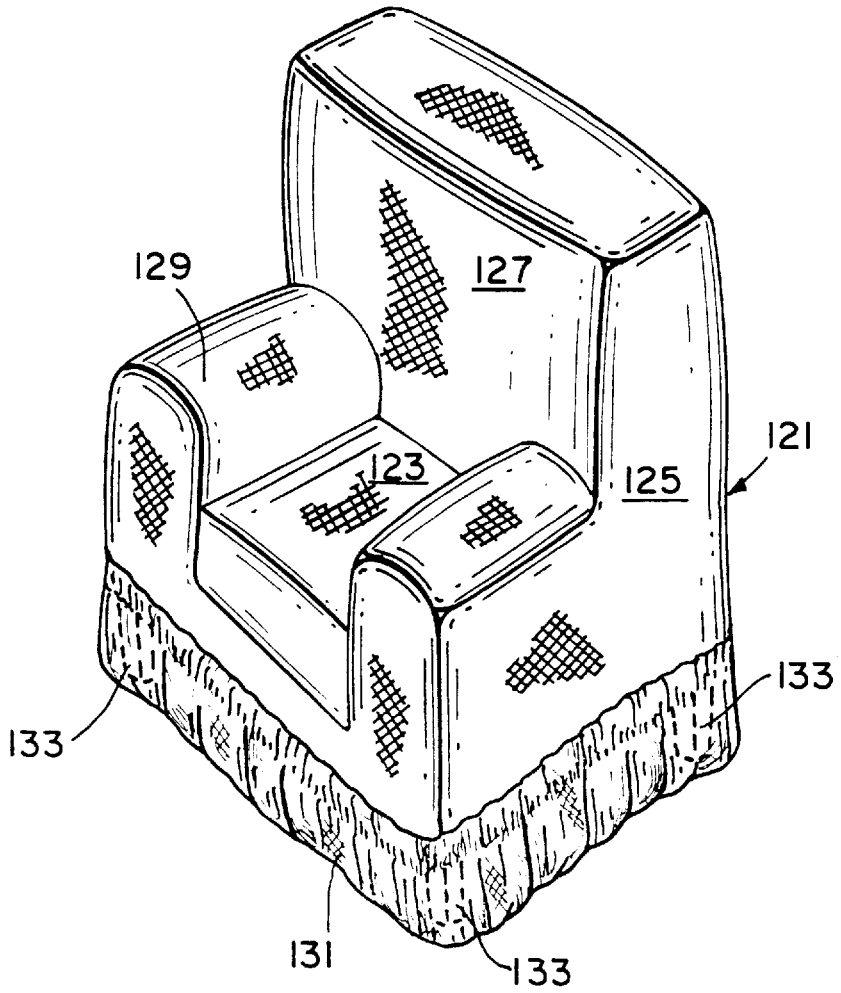
FIG. 18 is a perspective view of an upholstered chair in which an eighth embodiment of the dust ruffle construction of the invention is placed over the lower portion of the chair.

Turning now to FIG. 18, the inventive skirt design is shown now in conjunction with an upholstered chair generally indicated at 121. Chair 121 includes a cushioned seat 123, a back 127, sides 125, arms 129 and legs 133, as is well known in the art. Hollow skirt 131 has substantially the same design as the dust ruffle and skirts described in the earlier embodiments and includes a removable elastic tape member for facilitating securement of skirt 131 about legs 133 of chair 121.

Although the preferred embodiment of the inventive skirt design has the ends of the elastomeric tape member extending beyond the ends of the fabric sleeve, this feature is not required. In fact, the ends of the sleeve may extend beyond the ends of the tape such that when pushed up along the tape in order to attach the tape ends, an aesthetically pleasing ruffled appearance along the skirt will be formed.

Moreover, the tape member may be elastic along its entire length, or simply elastic along a portion thereof, without departing from the inventive concept.

It will thus be seen that the objects set forth above, among those made apparent from the above description, are achieved by the inventive design.

The inventive design accordingly comprises the features, construction and arrangement of elements and parts as described, by way of example, in the above description, and the scope of the invention will be indicated in the following claims.

I claim:

1. A decorative fabric skirt or cover for bedding, furniture and the like having a continuous outside surface comprising an elongated fabric sleeve having a first end and a second end and including an outer fabric wall and an inner fabric wall for defining an elongated passage running therebetween;

wherein said passage has a length defined by said walls of said sleeve and carries an elongated tape member intermediate to said inner and outer fabric walls and which is elastic along at least a portion of said length, said tape member being sized to selectively extend along a majority of the circumferential outer surface of said bedding, furniture and the like, said tape member having first and second ends extending beyond said ends of said fabric sleeve when carried within said passage, said tape member including an attachment for selectively connecting said ends thereof to each other such that said skirt or cover is selectively girdled by said tape member and thus fixed in position about said circumferential surface of said bedding, furniture and the like.

2. The skirt or cover of claim 1, wherein said elongated elastic tape member is selectively removable from within said passage.

3. The skirt or cover of claim 2, wherein said tape member includes a handle member located along at least one of said ends adapted for being grabbed in order to facilitate removal of said tape member from said sleeve.

4. The skirt of claim 3, wherein said handle means comprises at least one loop member fixed on said tape member end for selectively receiving and engaging with at least one hook element.

5. The fabric skirt or cover of claim 1, wherein said fabric sleeve is sized for covering at least a portion of a box spring.

6. The fabric skirt or cover of claim 1, wherein said attachment means includes at least one hook member fixed to one of said ends of said tape member and at least one eyelet formed at the other of said ends of the tape member for selective engagement with said at least one hook member.

7. The skirt or cover of claim 1, wherein said passage receives a form sized to provide a pre-determined shape to said sleeve.

8. The skirt or cover of claim 7, wherein said form has an outer convex surface.

9. The skirt or cover of claim 1, wherein said elastic tape member has a width substantially less than that of said sleeve passage.

10. The skirt or cover of claim 1, wherein said fabric sleeve is formed with a plurality of ruffles or bouffants.

11. The skirt or cover of claim 1, wherein said passage comprises only a portion of said sleeve.

12. The skirt or cover of claim 1, wherein said fabric sleeve defines a first upper portion through which said elastic tape member extends and a second lower portion.

13. The skirt or cover of claim 12, wherein a continuous longitudinal location along said outer and inner fabric walls is sewn together in order to define said upper and lower portions of said sleeve.

14. The skirt or cover of claim 1, wherein said passage is sized for receiving at least one bed pillow therein.

15. A bedding assembly comprising a box spring having a circumferential outside surface, a mattress lying thereon, and a frame for supporting said box spring and mattress, wherein said assembly further includes a decorative fabric skirt or cover for said box spring comprising an elongated fabric sleeve having a first end and a second end and including an outer fabric wall and an inner fabric wall for defining an elongated passage running therebetween;

wherein said passage defined by said walls of said sleeve carries an elongated elastic tape member intermediate to said inner and outer fabric walls, said tape member being selectively sized to extend along said outside surface along a majority of the length thereof, said tape member having first and second ends extending beyond the ends of said fabric sleeve when carried within said passage, said tape member including an attachment for selectively connecting said ends thereof to each other such that said skirt or cover is selectively girdled by said tape member and thus fixed in position about said outside surface of said box spring.

16. The assembly of claim 15, wherein said elongated elastic tape member is selectively removable from within said passage.

17. The assembly of claim 15, wherein said attachment means includes at least one hook member fixed to one of said ends of said tape member and at least one eyelet formed at the other of said ends of the tape member for selective engagement with said at least one hook member.

18. The assembly of claim 15, wherein said passage receives a form sized to provide a pre-determined shape to said sleeve.

19. The assembly of claim 15, wherein said elastic tape member has a width substantially less than that of said sleeve passage.

20. The assembly of claim 15, wherein said fabric sleeve is formed with a plurality of ruffles or bouffants.

21. The assembly of claim 15, wherein said passage comprises only a portion of said sleeve.

22. A bed headboard assembly comprising a headboard having a circumferential outside surface and a cover for said headboard comprising an elongated continuous fabric sleeve having a first end and a second end and formed with an internal passageway extending therethrough, said cover further including an elongated elastic tape member being disposed in said passageway and extending along the majority of the length of the cover, the tape member having first and second ends for selectively joining the tape member into a loop about said headboard outside surface such that said cover is selectively girdled by said tape member and, thus, fits snugly in position about the outside surface of said headboard.

23. A seating assembly comprising a furniture seating unit having a seat and at least one or more supporting members depending down therefrom, for defining a continuous lower outer periphery of said seating unit, the assembly further including a decorative fabric skirt or cover comprising an elongated fabric sleeve with an internal passage running therebetween, said passage carrying an elongated elastic tape member with ends extending beyond the ends of the sleeve and carried within said passage, the ends having attachment members fixed thereto for selectively joining the tape member ends to each other as said skirt or cover is wrapped about said lower outside periphery of said seating unit such that said skirt or cover is selectively girdled by said tape member, and thus fits snugly in position.

24. A decorative fabric skirt or cover for a bed pillow comprising an elongated fabric sleeve having a first end and a second end and including an outer fabric wall and an inner fabric wall for defining an elongated passage running therebetween;

wherein said passage is sized for receiving said at least one bed pillow therein and has a length defined by the walls of said sleeve for carrying an elongated tape member intermediate to said inner and outer fabric walls which is elastic along at least a portion of said length, said tape member having first and second ends extending beyond the ends of said fabric sleeve when carried within said passage, said tape member including an attachment for selectively connecting said ends.

25. A decorative fabric skirt assembly, as set forth in claim 24, wherein the fabric has a segment larger then a related segment of the tape, whereby the fabric may be gathered with respect to the tape for decorative purposes.

26. A method for functionally engaging a decorative fabric skirt or cover along a bedding assembly consisting of a box spring having an outside surface, a mattress lying thereon, and a frame supporting the box spring and mattress, the method comprising the steps of:

disposing an elongated elastic tape member within a passage defined by inner and outer fabric walls of an elongated fabric sleeve in order to define said skirt or cover such that the tape member has a first end extending beyond one end of the fabric sleeve and a second end extending beyond the other end of said fabric sleeve;

positioning said fabric cover with said disposed tape member around said outside surface of said box spring, and connecting one end of said tape member to the other end of said tape member such that said skirt or cover is girdled by said tape member and thus fixed in position about said outside surface of said box spring.

27. A decorative fabric skirt assembly for use with furniture having a continuous outer periphery, the assembly including (a) a continuous fabric extending about said furniture periphery;

(b) a passageway formed in said fabric extending essentially along the entire length thereof;

(c) an elongated elastic tape, said tape being located in said passageway and extending along at least a majority of the length of said fabric, and being sized to hold the fabric snugly against the furniture periphery;

(d) attachment members fixed to the ends of said tape for selectively joining the tape into a loop about said furniture periphery, whereby upon release of the attachment members, the fabric can be removed from said furniture periphery and, upon removal of the tape from the passageway, the fabric can be readily cleaned.

* * * * *